US011286592B2

(12) United States Patent
Tan et al.

(10) Patent No.: US 11,286,592 B2
(45) Date of Patent: Mar. 29, 2022

(54) METHOD FOR PRODUCING UNIDIRECTIONAL HYBRID-BRAIDED FABRICS

(71) Applicant: NEWTRY COMPOSITE CO., LTD., Jiangsu (CN)

(72) Inventors: Yuan Tan, Jiangsu (CN); Xiangwei Chen, Jiangsu (CN); Zhiqiang Wang, Jiangsu (CN); Bo Geng, Jiangsu (CN); Qing Niu, Jiangsu (CN); Liewei Zhu, Jiangsu (CN)

(73) Assignee: NEWTRY COMPOSITE CO., LTD., Jiangsu (CN)

( * ) Notice: Subject to any disclaimer, the term of this patent is extended or adjusted under 35 U.S.C. 154(b) by 279 days.

(21) Appl. No.: 15/540,004

(22) PCT Filed: Jun. 18, 2015

(86) PCT No.: PCT/CN2015/000427
§ 371 (c)(1),
(2) Date: Jun. 26, 2017

(87) PCT Pub. No.: WO2016/197277
PCT Pub. Date: Dec. 15, 2016

(65) Prior Publication Data

US 2018/0010270 A1 Jan. 11, 2018

(30) Foreign Application Priority Data

Jun. 9, 2015 (CN) ..... 201510313558.X

(51) Int. Cl.
*D04B 21/14* (2006.01)
*D04B 21/16* (2006.01)
(Continued)

(52) U.S. Cl.
CPC ..... *D04B 21/14* (2013.01); *D02G 3/18* (2013.01); *D04B 21/165* (2013.01); *D04B 27/10* (2013.01);
(Continued)

(58) Field of Classification Search
CPC ..... D04B 21/14; D04B 27/10; D04B 27/12; D04B 21/165; D10B 2403/02412; B29C 70/205; B29C 70/22
(Continued)

(56) References Cited

U.S. PATENT DOCUMENTS 4,567,738 A 2/1986 Hutson et al.
4,622,254 A * 11/1986 Nishimura ..... B29C 70/228 428/102
(Continued)

FOREIGN PATENT DOCUMENTS

CN 1926271 A 3/2007
CN 101876120 A 11/2010
CN 202099534 U 1/2012

OTHER PUBLICATIONS

ISA/CN, International Search Report dated Jan. 25, 2016, issued in International Application No. PCT/CN2015/000427, total 4 pages with English translation.

*Primary Examiner* — Khoa D Huynh
*Assistant Examiner* — Uyen T Nguyen
(74) *Attorney, Agent, or Firm* — Szdc Law P.C.

(57) ABSTRACT

The present invention discloses a method for producing unidirectional hybrid-braided fabrics, including: preparing a first layer of 0° warps; preparing a second layer of 0° warps to a Nth layer of 0° warps; preparing an auxiliary layer of wefts; preparing binding yarns; laying and hybrid-braiding the materials prepared in steps 1-4 to obtain unidirectional hybrid-braided fabrics; and cutting and winding. The 0°
(Continued)

warps and wefts of the invention are made of two or more layers of different fibers that are laid in a single direction and finally hybrid-braided. Therefore, two or more different types of materials can be laid, thereby ensuring the uniform distribution and thickness of the fibers in different areas of the hybrid-braided fabric. The grammage of different 0° warp fiber layers can be adjusted freely in a range of 30-3000 grams/$m^2$, thereby realizing performance and cost designability of a composite material.

4 Claims, 1 Drawing Sheet

(51) Int. Cl.
*D04B 27/10* (2006.01)
*D02G 3/18* (2006.01)
*D04B 27/12* (2006.01)

(52) U.S. Cl.
CPC .... *D04B 27/12* (2013.01); *D10B 2403/02412* (2013.01); *D10B 2505/02* (2013.01)

(58) Field of Classification Search
USPC ..... 87/8; 66/84 R
See application file for complete search history.

(56) References Cited

U.S. PATENT DOCUMENTS 4,703,631 A * 11/1987 Naumann ..... D04B 23/12 66/84 A
5,269,863 A * 12/1993 Middelman ..... B29C 70/16 156/176
5,445,693 A * 8/1995 Vane ..... D04H 3/002 156/93
6,000,055 A * 12/1999 Citterio ..... B32B 5/26 2/2.5
6,585,842 B1 * 7/2003 Bompard ..... D02J 1/18 156/166
6,668,596 B1 * 12/2003 Wagener ..... D04B 23/10 66/84 A
7,794,640 B2 * 9/2010 Healey ..... D04H 3/002 264/258
9,012,339 B2 * 4/2015 Chiou ..... F41H 5/0485 442/111
2002/0160146 A1 * 10/2002 Homma ..... D04B 23/10 428/102
2004/0219855 A1 * 11/2004 Tsotsis ..... B29C 70/443 442/364
2012/0100354 A1 * 4/2012 Beraud ..... D04H 3/002 428/212
2012/0177872 A1 * 7/2012 Tsai ..... B32B 5/12 428/113
2012/0270009 A1 * 10/2012 Kawabe ..... B32B 27/12 428/113
2015/0299913 A1 * 10/2015 Hori ..... B32B 5/26 428/34.1
2016/0083871 A1 * 3/2016 Meure ..... D04H 3/12 524/1
2016/0375633 A1 * 12/2016 Bergstrom ..... B29C 70/48 428/188
2018/0126674 A1 * 5/2018 Ohtani ..... B29C 43/18

* cited by examiner

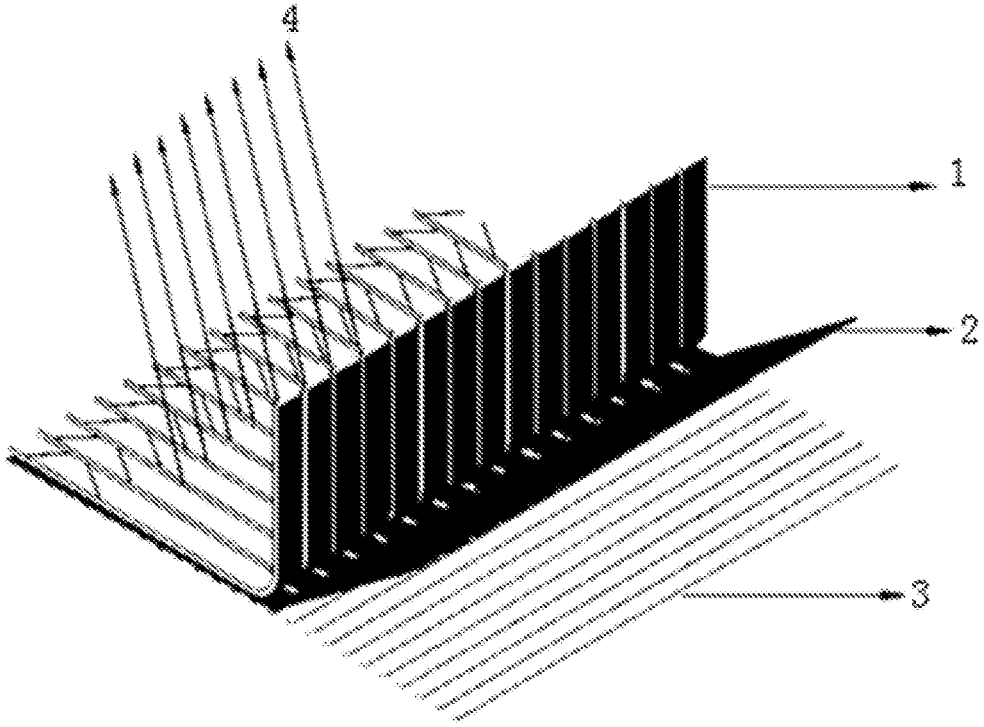
4
1
2
3

METHOD FOR PRODUCING UNIDIRECTIONAL HYBRID-BRAIDED FABRICS

RELATED APPLICATIONS

This application is the U.S. National Phase application under 35 U.S.C. § 371 of International Patent Application No. PCT/CN2015/000427, International Filing Date Jun. 18, 2015, which claims priority to Chinese Patent Application No. 201510313558.X, filed Jun. 9, 2015, which are hereby expressly incorporated by reference in their entirety for all purposes.

FIELD OF THE INVENTION

The present invention relates to a method for producing unidirectional hybrid-braided fabrics.

DESCRIPTION OF THE RELATED ART

In common unidirectional hybrid warp knitting fabric, materials are generally laid in a single layer in a mixed manner. As hybrid materials, glass fibers, carbon fibers, and basalt fibers are ordinarily used as main bearing materials, and other fibers such as aramid fibers, ultra-high molecular weight polyethylene fibers, polyamide fibers, polyphenylene sulfide fibers, polyimide fibers, polyester fibers, polypropylene fibers, and nylon fibers are applied as toughening materials, thereby achieving a hybrid combination of two or more types of fibers. The warp density of the warp knitting fabric is generally 5 threads/inch, 6 threads/inch, 7 threads/inch, 10 threads/inch, or the like, regular specifications of glass fibers are 300 tex, 600 tex, 1200 tex, and 2400 tex, regular specifications of carbon fibers are 3 K, 6 K, 12 K, 24 K, and 50 K, and regular specifications of organic fibers such as aramid fibers and ultra-high molecular weight polyethylene fibers are 500 D, 1000 D, and 1500 D. Different types of fibers have different densities.

In the industry of high-performance fiber composite materials, the uniform distribution of fibers in resin matrix is one of the key factors that affect the performance of composite materials. Limited by the warp density and raw material specifications of warp knitting fabric, and due to the difference of densities among different materials, if it is desired that different fiber materials in a single layer of hybrid warp knitting fabric have a uniform thickness, the designability of the hybrid warp knitting fabric will be significantly restricted, and therefore it will be difficult to realize a low-cost commercial process for products.

SUMMARY OF THE INVENTION

An object of the present invention is to provide a method for producing unidirectional hybrid-braided fabrics, which can ensure uniform distribution and uniform thickness of layers in different areas of the hybrid-braided fabrics, thereby achieving the designability of performance and the low cost of a composite material.

A technical solution of the present invention is a method for producing unidirectional hybrid-braided fabrics, and the method includes the following steps:

step 1: preparing a first layer of 0° warp yarns;

step 2: preparing a second layer of 0° warp yarns to a Nth layer of 0° warp yarns, wherein N is a natural number greater than or equal to 2;

step 3: preparing an auxiliary layer of weft yarns;

step 4: preparing binding yarns;

step 5: laying and hybrid-braiding the materials prepared in step 1 to step 4 to obtain unidirectional hybrid-braided fabrics; and step 6: cutting and winding.

Preferably, in the step 1 and step 2, a method for preparing the first layer of 0° warp yarns and the second layer of 0° warp yarns to the Nth layer of 0° warp yarns comprises: calculating the required number of fiber warps according to a design requirement of area weight of unidirectional fabrics as well as specifications of selected fibers, and preparing a unidirectional tackified fiber tape on a fiber spreading tackification device.

Preferably, in the step 1 and step 2, the prepared unidirectional tackified fiber tape is winded on a warp beam provided with baffle plates on both sides thereof, and the warp beam on which the unidirectional tackified fiber tape is winded is placed on a warp beam creel for unwinding.

Preferably, in the step 1 and step 2, during unwinding tension is controlled by using a mechanical tension spring friction tape or an electronic constant torque.

Preferably, in the step 2, a method for preparing the second layer of 0° warp yarns to the Nth layer of 0° warp yarns comprises: placing a different type of fibers on creels, performing outer-ring unwinding or inner-ring unwinding according to product performance requirements, and calculating the required number of fiber warps according to a design requirement of area weight of unidirectional fabrics as well as fiber specifications, and wrapping the fibers on a warp let-off roller, wherein the tension is controlled by a rotation speed of the warp let-off roller.

Preferably, in the step 3, the auxiliary layer of weft yarns are laid at an angle of 90°, ±M°, or at multiple angles, and wherein M>0.

Preferably, in the step 3, the auxiliary layer of weft yarns is laid by a weft insertion device, and the tension is controlled by using a mechanical tension spring friction tape or an electronic constant torque.

Preferably, in the step 4, a method for preparing the binding yarns comprises: placing binding yarn fibers on a creel to prepare a pan-head warp beam by using a warping machine, or controlling the tension of a single binding yarn on a creel by a yarn tensioner.

Preferably, in the step 5, laying tension is controlled mechanically or electronically, and the materials are hybrid-braided on a bi-axial warp knitting machine, a multi-axial warp knitting machine, or a stitch-bonding machine.

Preferably, the first layer of 0° warp yarns, the second layer of 0° warp yarns to the Nth layer of 0° warp yarns, and the auxiliary layer of weft yarns are selected from the group consisting of glass fiber, carbon fiber, basalt fiber, aramid fiber, ultra-high molecular weight polyethylene fiber, polyamide fiber, polyphenylene sulfide fiber, polyimide fiber, polyester fiber, polypropylene fiber and nylon fiber, the warp yarns and weft yarns are of different materials, and different layers of 0° warp yarns are of different materials.

By means of the above technical solution, the present invention has the following beneficial effects:

(1) The present invention breaks away from the conventional manner of laying in a single layer, and in a primary direction, that is, 0° warp yarns whose grammage accounts for 90% or higher are made of two or more layers of different fibers that are laid in a single direction and finally hybrid-braided. Therefore, two or more different materials can be laid, ensuring the uniform distribution and uniform thickness of the fibers in different areas of the hybrid-braided fabric; the grammage of different 0° warp fiber layers can be adjusted freely in a range of 30-3000 grams/m$^2$, thereby realizing performance and cost designability of a composite material. Layers of fibers are prepared in an early phase, and the fibers are finally braided in one time, this can save the cost of at least one time of braiding. Furthermore, tension of each layer can be separately controlled, and this will significantly improve the performance of the fabric.

(2) The number of warp-wise fiber layers can be set to any value in the present invention, and the materials may also be selected as required. Therefore, the materials of fibers, and the number of layers as well as grammage of the fibers can be determined according to the requirements of an application scenario of braided fabric.

(3) There are multiple preparation methods and tension control methods for warp and weft yarns in the present invention, and the method may be selected according to an actual condition.

BRIEF DESCRIPTION OF THE DRAWINGS

To make it easier to clearly understand the content of the present invention, the present invention is described in further detail according to specific embodiments in combination with the accompanying drawing, wherein FIG. 1 is a schematic diagram of a braiding method according to the present invention.

wherein: 1. a first layer of 0° warp yarns; 2. a second layer of 0° warp yarns; 3: an auxiliary layer of weft yarns; 4. binding yarns.

DETAILED DESCRIPTION OF THE PREFERRED EMBODIMENTS

Embodiment 1

Referring to FIG. 1, the embodiment 1 describes in detail a method for producing unidirectional hybrid-braided fabrics by using two layers of 0° warp yarns, the method comprises the following steps:

Step 1: Preparation of a First Layer of 0° Warp Yarns 1

Carbon fibers are used as the first layer of 0° warp yarns 1, with specifications as follows: 12 K, 800 tex, 100 g/m$^2$, and 125 threads. An unidirectional tackified fiber tape is prepared on a fiber spreading tackification device, and the prepared unidirectional tackified fiber tape is winded on a warp beam provided with baffle plates on both sides thereof, the warp beam, on which the unidirectional tackified fiber tape is winded, is placed on a warp beam creel for unwinding, and during unwinding tension is controlled by using a mechanical tension spring friction tape or an electronic constant torque.

Step 2: Preparation of a Second Layer of 0° Warp Yarns 2

Glass fibers are used as the second layer of 0° warp yarns 2 with specifications as follows: 2400 tex, 1196 g/m$^2$, and 635 threads. A method the same as that in step 1 may be used, or fibers of a type different from that of the fibers used in step 1 are placed on a creel, outer-ring unwinding or inner-ring unwinding is carried out according to product performance requirements, and the required number of fiber warps is also calculated according to the design requirement of area weight of the unidirectional fabrics in combination with fiber specifications, the fibers are wrapped on a warp let-off roller, and the tension is controlled by a rotation speed of the warp let-off roller.

Step 3: Preparation of an Auxiliary Layer of Weft Yarns 3

Glass fibers are used as the auxiliary layer of weft yarns 3 with specifications as follows: 136 tex, 40 g/m$^2$, and 64 threads. The auxiliary layer of weft yarns 3 are laid at an angle of 90° by using a weft insertion device and the tension is controlled by using a mechanical tension spring friction tape or an electronic constant torque.

Step 4: Preparation of Binding Yarns 4

Low stretch yarns are used as the binding yarns 4 with specifications as follows: 83/36 F, 8 g/m$^2$, and 141 threads. Binding yarn fibers are placed on a creel to prepare a pan-head warp beam by using a warping machine, or the tension of a single binding yarn on a creel is controlled by using a yarn tensioner.

step 5: laying the materials prepared in step 1 to step 4 laying tension is controlled mechanically or electronically, and the materials are hybrid-braided on a bi-axial warp knitting machine, a multi-axial warp knitting machine, or a stitch-bonding machine to obtain unidirectional hybrid-braided fabrics, wherein a hybrid braiding speed is 2 m/min.

Step 6: Cutting and Winding

The rear selvage of the fabric is cut, and the fabric is cut into pieces with a specific width, and finally the fabric is winded around a center or by means of friction, the width is 1.27 m.

The first layer of 0° warp yarns 1, the second layer of 0° warp yarns 2, and the auxiliary layer weft yarns 3 are selected from the group consisting of glass fiber, carbon fiber, basalt fiber, aramid fiber, ultra-high molecular weight polyethylene fiber, polyimide polyamide fiber, polyphenylene sulfide fiber, polyimide fiber, polyester fiber, polypropylene fiber, or nylon fiber, the warp yarns and weft yarns are of different materials, and two layers of 0° warp yarns are of different materials.

The objectives, technical solutions, and beneficial effects of the present invention are described in further detail in combination with the above specific embodiment. It should be noted that, the above description is merely a specific embodiment of the present invention but is not intended to limit the present invention. Any modification, equivalent replacement, and improvement made without departing from the spirit and principle of the present invention shall fall within the protection scope of the present invention.

What is claimed is:

1. A method for producing unidirectional hybrid-braided fabrics, comprising step 1: preparing a first layer of 0° warp yarns (1);

step 2: preparing a second layer of 0° warp yarns (2) to a Nth layer of 0° warp yarns, wherein N is a natural number greater than or equal to 2;

step 3: preparing an auxiliary layer of weft yarns (3);

step 4: preparing binding yarns (4);

step 5: laying the first layer prepared in step 1 directly onto the second layer prepared in step 2, laying the second layer directly onto the auxiliary layer prepared in step 3, and hybrid-braiding the first layer, the second layer and the auxiliary layer with the binding yarns of step 4 to obtain unidirectional hybrid-braided fabrics; and step 6: cutting and winding;

wherein the first layer of warp yarns, the auxiliary layer of weft yarns, and the Nth layers of 0° warp yarns are of different materials, wherein in the step 3, the auxiliary layer of weft yarns (3) are laid at an angle of 90°, ±M°, or at multiple angles, wherein M>0, wherein the first layer of 0° warp yarns (1), the second layer of 0° warp yarns (2) to the Nth layer of 0° warp yarns, and the auxiliary layer of weft yarns (3) are selected from the group consisting of glass fiber, carbon fiber, basalt fiber, aramid fiber, ultra-high molecular weight polyethylene fiber, polyamide fiber, polyphenylene sulfide fiber, polyimide fiber, polyester fiber, polypropylene fiber and nylon fiber, the warp yarns and weft yarns being of different materials, wherein the first layer of 0° warp yarns (1) and the second layer of 0° warp yarns (2) to the Nth layer of 0° warp yarns are of different materials, wherein two or more of the first layer of 0° warp yarns (1) and the second layer of 0° warp yarns (2) to the Nth layer of 0° warp yarns whose grammages account 90% or more are laid in a single direction and hybrid-braided, and wherein the first layer of 0° warp yarns (1) and the second layer of 0° warp yarns (2) to the Nth layer of 0° warp yarns have a grammage of between 30 to 3,000 grams/$m^2$.

2. The method for producing unidirectional hybrid-braided fabrics according to claim 1, wherein in the step 3, the auxiliary layer of weft yarns (3) is laid by a weft insertion device, and a tension being controlled by using a mechanical tension spring friction tape or an electronic constant torque.

3. The method for producing unidirectional hybrid-braided fabrics according to claim 1, wherein in the step 4, a method for preparing the binding yarns (4) comprises: controlling a tension of a single binding yarn on a creel by a yarn tensioner.

4. The method for producing unidirectional hybrid-braided fabrics according to claim 1, wherein in the step 5, laying tension is controlled mechanically or electronically, and the first layer, the second layer, the auxiliary layer and binding yarns are hybrid-braided on a bi-axial warp knitting machine, a multi-axial warp knitting machine, or a stitch-bonding machine.

* * * * *